US005939687A

United States Patent [19]

Ellermann

[11] Patent Number: 5,939,687

[45] Date of Patent: Aug. 17, 1999

[54] KNEE-OPERATED SWITCH FOR A WORKING MACHINE, ESPECIALLY A SEWING MACHINE

[75] Inventor: Rolf Ellermann, Bielefeld, Germany

[73] Assignee: Durkopp Adler Aktiengellschaft, Germany

[21] Appl. No.: 09/002,664

[22] Filed: Jan. 5, 1998

[30] Foreign Application Priority Data

Feb. 14, 1997 [DE] Germany ..... 197 05 640

[51] Int. Cl.[6] ..... H01H 3/16

[52] U.S. Cl. ..... 200/61.58 R; 200/512; 200/293; 112/217.3

[58] Field of Search ..... 200/512, 61.58 R, 200/293; 112/217.3, 217.4

[56] References Cited

U.S. PATENT DOCUMENTS 3,812,313 5/1974 Wolf et al. ..... 200/86 R 3,818,162 6/1974 Monroe et al. ..... 200/86 R

FOREIGN PATENT DOCUMENTS 1166885 4/1964 Germany .

*Primary Examiner*—Michael L. Gellner
*Assistant Examiner*—Lee S. Lum
*Attorney, Agent, or Firm*—Ostrolenk, Faber, Gerb & Soffen, LLP

[57] ABSTRACT

A knee-operated switch for a working machine, the switch including a carrier supported to the machine and a profile extending off the carrier at an angle to the profile. The profile includes first and second elongate, parallel electric contact strips that are normally separated. Sheathing over at least one of the strips is deflectable to in turn deflect the contact strips into engagement. Support strips support the contact strips normally apart until the contact strips are deflected together. A flexible elastic housing over the sheathing and the strips is deflectable to deflect the sheathing to move the contact strips together. The switch profile extends over a length so that actuation can take place at different actuating points along the profile.

8 Claims, 1 Drawing Sheet

KNEE-OPERATED SWITCH FOR A WORKING MACHINE, ESPECIALLY A SEWING MACHINE

BACKGROUND OF THE INVENTION

The present invention relates to a knee-operated switch for a working machine, and particularly a sewing machine, or the like.

German patent specification 1,023,305, which corresponds to U.S. Pat. No. 2,882,817 discloses a knee-operated switch having a switch rod that is displaceable counter to the force of a spring and having a switch contact and which feeds current to a consuming apparatus as a function of its switching state.

Working machines, for example, sewing machines and leatherworking machines, are generally located on or are set into a worktop so that an operator can use them while seated. Machines of this type often have a knee-operated switch located below the worktop, in addition to a pedal. The knee-operated switch triggers particular functions and may be actuated by a force exerted by the operator's knee, e.g. by swinging the knee sideways. Recent design knee-operated switches are so arranged on the underside of the worktop that their positions can be adjusted. This enables the actuating position to be appropriately set as a function of the operator's body dimensions. But such setting of the knee-operated switch is troublesome especially when different operators operate the same working machine.

More modern knee-operated switches are designed with a housing and with an actuating plate that is mounted in a hinge-like manner on the housing. The plate is often glued with sponge rubber inside the housing. The plate includes switches. Such knee-operated switches are comprised of several components, so that their production costs are high. Another disadvantage of known knee-operated switches actuating them requires that a definite force be exerted over a particular switch travel.

SUMMARY OF THE INVENTION

The object of the present invention is to provide a knee-operated switch which avoids the above disadvantages and which can be produced cost effectively.

The invention comprises a knee-operated switch for a working machine. The switch includes a carrier supported to the machine and a profile extending off the carrier at an angle to the profile. The profile includes first and second elongate, parallel and overlying electric contact strips that are normally separated. Sheathing over at least one of the strips is deflectable to in turn deflect the contact strips into engagement. Support strips support the contact strips normally apart until the contact strips are deflected together. A flexible elastic housing over the sheathing and the strips is deflectable to deflect the sheathing to move the contact strips together. The switch profile extends over a length so that actuation can take place at different actuating points along the profile. The invention provides a knee-operated switch which has virtually no movable components, and achieves a reliable working mode.

Use of a switch like that known from DE-B-1,166,885 further ensures considerably reduced production costs. The use of the switch extending over some length results automatically in a kind of cushion, with the consequence that the knee-operated switch is pleasant to use. Another advantage is that the knee-operated switch is completely encased. Therefore it is not exposed to dust and dirt, which ensures a durable working mode. This has the further advantage that the knee-operated switch has a smooth shape all round.

The length of the profile enables the knee-operated switch to be used irrespective of the operator's body dimensions, so that further measures for providing adjustability of the knee-operated switch and associated further costs are avoided. The elastic, and plastic sheathing is deformable and includes a force concentration bead extending along the sheathing determining an actuating force which is constant over the length of the switch, and the bead defines an exactly defined switching travel.

Other objects and features of the invention are disclosed in the following description of an embodiment with reference to the accompanying drawings.

PREFERRED EMBODIMENT OF THE INVENTION

Figure 1:
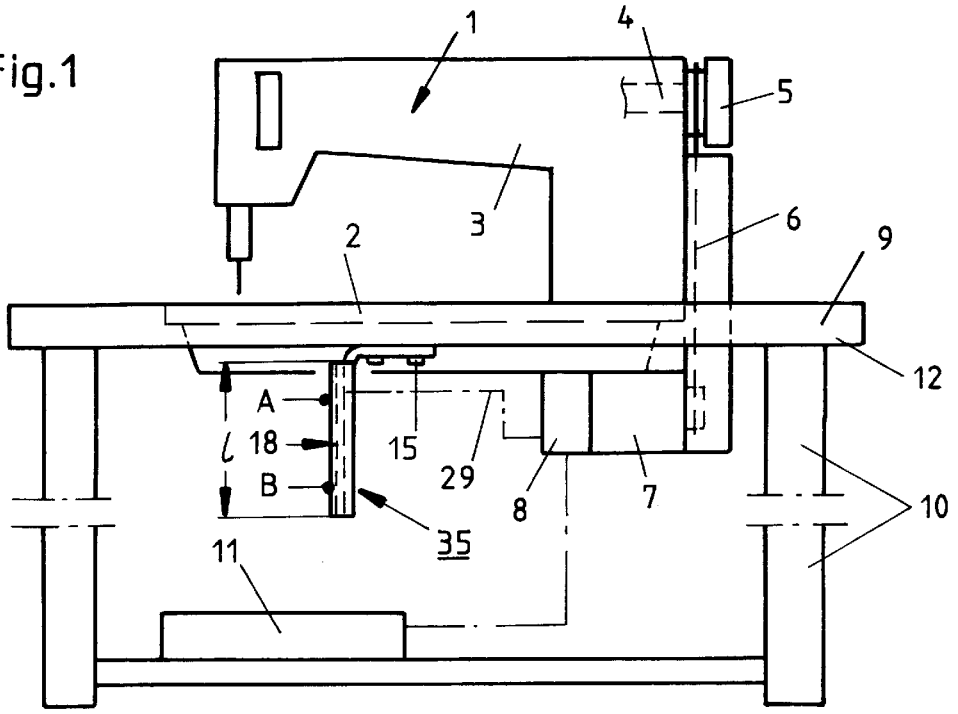
FIG. 1 shows a schematic front view of a sewing machine including the knee-operated switch according to the invention.
Figure 2:
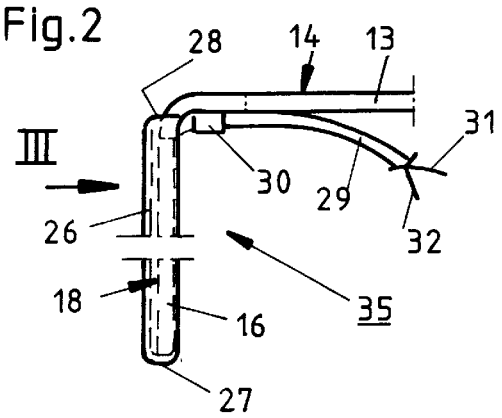
FIG. 2 is an enlarged view of the knee-operated switch in FIG. 1.

A working machine, particularly a sewing machine 1, is designed conventionally and includes a baseplate or working surface 2 and an angular shaped arm 3 fastened to the plate 2. An arm shaft 4 projects from the rear, right hand end of the arm 3. The arm shaft 4 is provided with a handwheel 5 on it. The wheel 5 is drive connected in a conventional way, e.g. via a belt drive 6, to a drive motor 7 which is electric circuit-connected to a control 8.

The sewing machine 1 is set with its baseplate 2 into a larger area worktop 9 which is supported by a stand 10. On its lower part, the stand has a conventional pivotable pedal 11.

Figure 5:
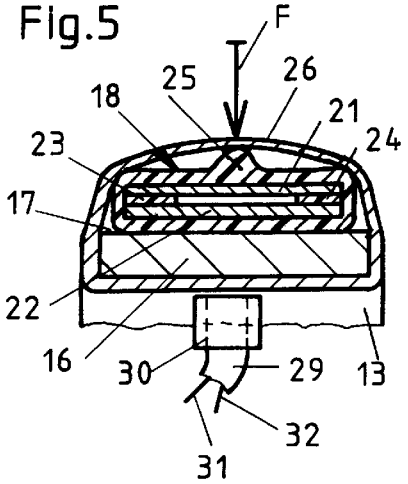
FIG. 5 is a sectional view of the knee-operated switch along section line V—V in FIG. 3 and on an enlarged scale.
Figure 3:
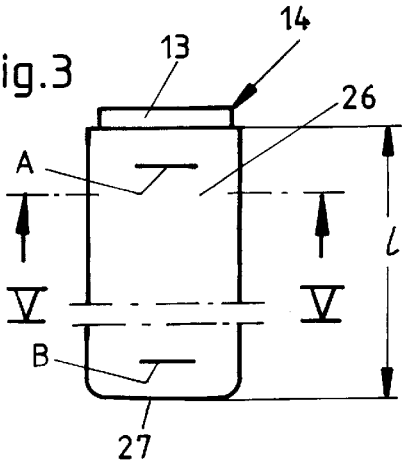
FIG. 3 is a side view of the knee-operated switch in the direction of the arrow III in FIG. 2.
Figure 4:
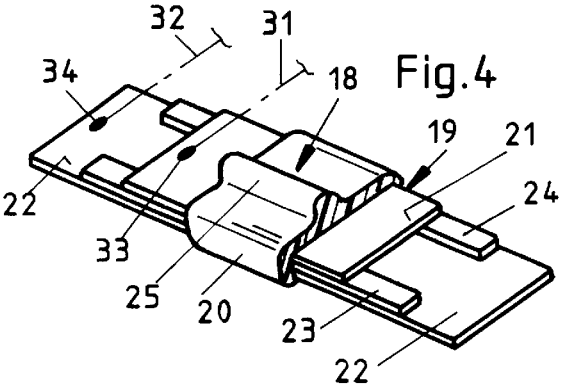
FIG. 4 is a perspective view of the switch used for the knee-operated switch.

One leg 13 of a right angular shape carrier 14 is firmly screwed to the underside 12 of the worktop 9 by screws 15, so that the free leg 16 of the carrier 14 extends approximately vertically downtoward toward the pedal 11. A switch 18 is located on one side 17 of the leg 16. The switch is adhesively bonded to the leg, for example, by a suitable adhesive. In FIGS. 4 and 5, the switch 18 has a cross section which is designated as a profile 19 and which extends over a length l. The length l corresponds approximately to the length dimension of the leg 16.

The profile 19 has an elastic plastic material sheathing 20 which is hollow. The sheathing 20 encloses contact strips 21 and 22, which are embedded therein, are produced from an elastic metal, for example spring sheet steel having a thickness of 0.2 millimeters, and are able to conduct electric current. The contact strips 21 and 22 are elongated about as long as the profile, are flat, parallel and overlying. Separation strips 23, 24 are located in the region of the edges of and between the contact strips 21, 22. The strips 23, 24 are manufactured from plastic. On the one hand, the strips 23, 24 position the contact strips 21, 22 at a spaced distance from one another. On the other hand, they electrically insulate the strips 21, 22 from one another. Further, the sheathing 20 has a bead 25 on the one side of the profile normally toward the operator's knee and midway between the separation strips 23, 24 to concentrate force midway between the strips 23, 24 and on contact strip 21.

The described switch 18 comprised of the contact strips 21, 22 together with insulating strips 23, 24 and the sheathing 20, is available in the trade as a so-called ribbon switch, manufactured and/or sold by the meter.

In FIG. 5, the switch 18 and the leg 16 are surrounded by a bag-shaped housing 26, so that the switch 18 and the leg 16 are enclosed all round them and on one end face 27 they are completely in the housing 26. The housing 26 is, in turn, manufactured from elastic plastic and is convexly shaped in the region of the bead 25.

The arrangement and design of the contact strips 21, 22 together with the strips 23, 24 located between the strips 21, 22 are such that, when a force F is applied against the housing 26, the bead 25 bends the contact strip 21 elastically in the manner of a beam held on two supports, until the contact strips 21, 22 touch one another. The contact strip 21 to that extent constitutes a spring that counteracts the force F.

At its end 28 toward the leg 13, the switch 18 is connected to a cable 29 which is fastened to the leg 13 by a cable clip 30. The cable 29 contains two electric leads 31, 32. The lead 31 is connected to a solder joint 33 on the contact strip 21 and the lead 32 is connected to a solder joint 34 on the contact strip 22. The design of the switch 18 described above with reference to FIGS. 2 to 5 and the remaining components form a knee-operated switch 35. The cable 29 is electric circuit-connected to the control 8.

The operation of the knee-operated switch is as follows:

When working, an operator sits in front of a sewing machine 1, with his or her foot or feet standing on the pedal 11, and the right knee located directly next to the knee-operated switch 35 on the left side of the knee, according to FIG. 1, without any force exerted on the switch. The working range of the knee-operated switch 35 is limited by the illustration of actuating positions A and B in FIG. 1. The knee-operated switch 35 can be used over the length l without any adjustment, irrespective of the operator's body size.

To start operation of the sewing machine 1, the operator exerts force F on the housing 26 with the right knee. This elastically deforms the housing 26, and the force F acts on the bead 25 and thus bends the contact strip 21. The contact strips 21, 22 are thereby brought into contact, enabling a current to flow through the leads 31, 32. The control 8 thereby causes the desired functioning of the sewing machine 1.

Removing the operator's knee from the knee-operated switch 35 cancels the elastic bending of the contact strip 21. The strip consequently resumes its initial out of contact position and prevents the flow of current.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A knee-operated switch for a machine, wherein the switch is supported on a platform of the machine and the switch is to be pressed by a knee of an operator, the switch comprising a profile extending over a length and in a direction beneath the platform of the machine for being contactable by the knee of an operator over at least a portion of the length of the profile; the profile having an end region;

a pair of normally separated electrically conducting contact strips extending over the length of the profile;

elastic sheath material at at least one of the contact strips;

an elastic housing enclosing the profile;

a carrier for the profile supporting the profile at the end region thereof for supporting the profile to the machine.

2. The switch of claim 1, wherein the length of the profile extends such that actuation can take place at different actuating positions along the profile.

3. The switch of claim 1, wherein the elastic sheath is comprised of material which lays over at least one of the contact strips and absorbs force applied to the elastic sheath and transmits the force to the at least one contact strip for bringing the contact strips together.

4. The switch of claim 3, wherein the elastic sheath includes a bead thereon disposed toward the side of the switch normally engaged by the knee for absorbing and concentrating at the bead the force applied by the knee to the switch.

5. The switch of claim 1, wherein the elastic sheath extends over at least one of the contact strips, the elastic housing is deflectable into engagement with the elastic sheath upon an operator's knee applying force to the housing, a separation element between the contact strips for normally separating the contact strips, and the at least one contact strip is deflectable with respect to the separation element upon force being applied to the housing and deflecting the housing into engagement with the elastic sheath for deflecting the contact strips into engagement.

6. The switch of claim 5, wherein the carrier is angled off from the direction of extension of the profile beneath the platform.

7. The switch of claim 1, wherein the carrier is angled off from the direction of extension of the profile beneath the platform.

8. The switch of claim 1, wherein the contact strips are elongate substantially over the length of the profile and are parallel.

* * * * *